United States Patent [19]

Walton

[11] Patent Number: 4,730,770

[45] Date of Patent: Mar. 15, 1988

[54] FLAT TOP END CLOSURE FOR LIQUID CONTAINERS

[75] Inventor: Janet L. Walton, Marietta, Ga.

[73] Assignee: Pure-Pak Inc., Walled Lake, Mich.

[21] Appl. No.: 64,669

[22] Filed: Jun. 22, 1987

[51] Int. Cl.[4] ..... B65D 5/08

[52] U.S. Cl. ..... 229/125.42; 206/621.3; 206/628; 206/631.2; 229/137

[58] Field of Search ..... 229/7 R, 17 R, 137, 229/138; 206/621, 625, 626, 628, 621.3, 631.2

[56] References Cited

U.S. PATENT DOCUMENTS

| | | | |
|---|---|---|---|
| 2,034,594 | 3/1936 | Norris et al. | 229/17 R |
| 2,162,556 | 6/1939 | Lagaard | 229/17 R |
| 3,003,673 | 10/1961 | Clark et al. | 229/17 R |
| 3,269,644 | 8/1966 | Bump | 206/621 |
| 3,281,048 | 10/1966 | Koltz et al. | 229/17 R |
| 4,520,929 | 6/1985 | Lisiecki | 229/17 R |

*Primary Examiner*—Stephen Marcus
*Assistant Examiner*—Gary E. Elkins
*Attorney, Agent, or Firm*—John P. Moran

[57] ABSTRACT

There is disclosed herein a flat top end closure for a liquid carrying container, which includes two oppositely disposed, overlapped outer closure panels, a folded over panel segment on one of them, and two oppositely disposed, fold-in panels, one of which serves as the pour spout when opened. Each of the fold-in panels includes a plurality of score lines, permitting each of the fold-in panels to be folded into two four layer thick portions beneath the outer closure panels such that no raw edge is adjacent the liquid contents. First and second lift tabs are formed on the edges of one of the outer closure panels and the pour spout fold-in panel, respectively. Diagonal opening-assist score lines are formed on the outer closure panels adjacent the pour spout.

5 Claims, 8 Drawing Figures

FLAT TOP END CLOSURE FOR LIQUID CONTAINERS

TECHNICAL FIELD

This invention relates generally to thermoplastic coated paperboard containers for carrying liquids and blanks for constructing same and, more particularly, to an improved, easy openable flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same is conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force against the outside panel to bend the sealed fin downwardly.

In U.S. Pat. No. 4,206,867, a wide score line is formed on one side of the gable panels, in lieu of the above mentioned double score lines, with a conventional score line of the opposite side providing unequal foldback panels.

In the above mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

U.S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tab is integrally formed on one outer closure panel for initial lifting of a portion of the pitcher pour spout, and an underlying lift tab is formed on one foldback closure panel of another portion of the pitcher pour spout, in order to facilitate the opening process.

In liquid carrying paperboard container constructions generally for sensitive food products such as milk or fruit juice, it is essential that the top closure be thoroughly sealable so as to be clean and sanitary and yet be functional from the standpoint of including means for readily opening the pouring spout thereof. As illustrated and described in the above mentioned U.S. Pat. No. 3,270,940, antiadhesive or "abhesive" patterns have been utilized, primarily on one or both sides of the rib panels located outward of the infolded triangular foldback panels and inward of the outer edge sealing flaps. In the flat top structure disclosed in the above mentioned U.S. Pat. No. 4,422,570, wherein there is no conventional sealing fin, such as the usual rib panels and sealing flaps, arrangements such as shown and described in U.S. Pat. No. 4,582,246 for releasably sealing the top closure are required.

DISCLOSURE OF THE INVENTION

Accordingly, a general object of the invention is to provide an improved flat end closure for a liquid carrying, paperboard container which may be readily opened.

Another object of the invention is to provide an improved flat top end closure which is not formed from a sealed fin arrangement, and includes a dual lift tab arrangement for opening.

A further and principal object of the invention is to provide a flat top end closure which has no raw edges exposed to the liquid contents, and which may be readily opened.

These and other objects and advantages of the invention will be apparent when reference is made to the following description and accompanying drawings.

BEST MODE FOR CARRYING OUT THE INVENTION

Figure 1:
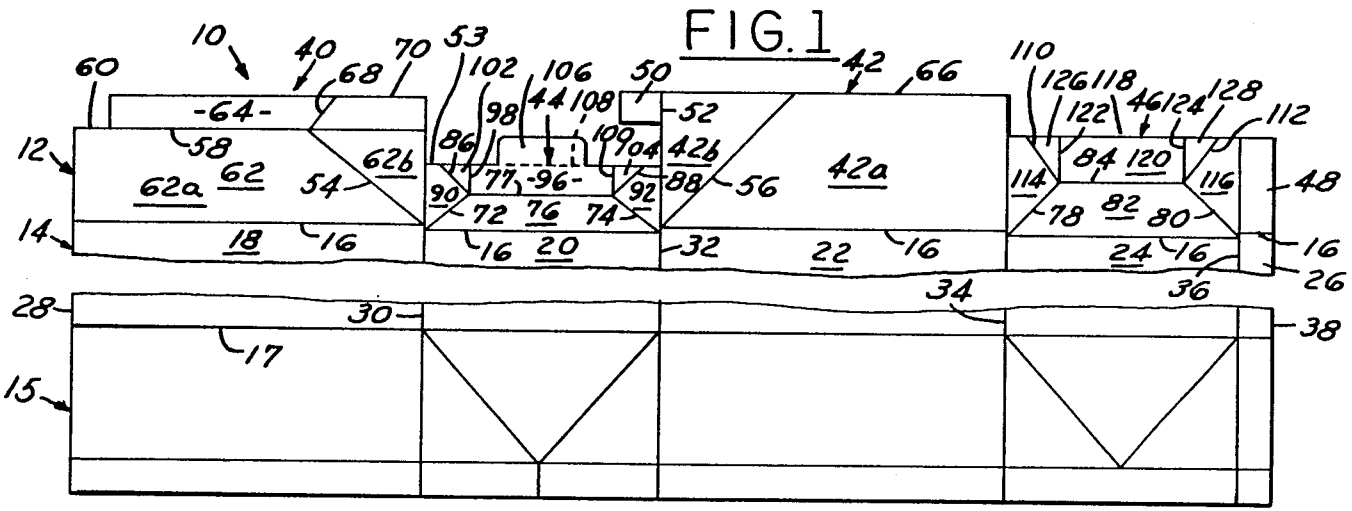
FIG. 1 is a fragmentary layout view of a blank from which the top end closure of the invention is formed, showing the outside surface thereof.

Referring now to the drawings in greater detail, FIG. 1 illustrates the outside surface of a blank 10 including a top closure portion 12, a body portion 14, and a bottom closure portion 15. The portions 12 and 14 are separated by a staggered horizontal score line 16, and the portions 14 and 15 are separated by a horizontal score line 17. The body portion 14 includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 26, and a second free cut edge 38.

A pair of outer top closure panels 40 and 42 are integrally connected to the first and second side panels 28 and 22, respectively, at the score line 16. A pair of fold-in top panels 44 and 46 are integrally connected to the front and back panels 20 and 24, respectively, at the score line 16. The top panels are integrally connected to each other by the above mentioned vertical score lines. An end closure extension 48 of the side seam 26 is integrally connected to the latter at the score line 16 and to the fold-in panel 46 at the score line 36. The panel 44 will serve as a pour spout, as will be explained.

A lift tab 50 is formed on the upper edge portion of the top panel 42 so as to be integrally connected thereto by a score line 52 extension of the vertical score line 32, extending laterally and substantially parallel to a portion of the free cut edge 53 of the panel 44.

Opening-assist diagonal score lines 54 and 56 are formed on the outer top panels 40 and 42, respectively. The line 54 extends substantially from the intersection of the vertical score line 30 and the horizontal score line 16 to a horizontal score line 58 formed across the panel 40. The score line 58 terminates in a free cut edge 60, and divides the panel 40 into panels 62 and 64, while the diagonal score line 54 divides the panel 62 into segments 62*a* and 62*b*. The score line 56 extends from the intersection of the score lines 32 and 16 to the free cut edge 66 of the panel 42, dividing the panel 42 into segments 42*a* and 42*b*, the lift tab 50 extending from the segment 42*b*. A diagonal score line 68 is formed across the panel 64 from the end of the diagonal score line 54 at the score line 58, to the free cut edge 70 of the panel 64.

A pair of converging diagonal score lines 72 and 74 are formed on the fold-in top panel 44, forming a trapezoidal-shaped pouring panel 76 with the horizontal score line 16 and a parallel score line 77. Likewise, a pair of converging diagonal score lines 78 and 80 are formed on the fold-in top panel 46, forming a trapezoidal-shaped panel 82 with the horizontal score line 16 and a parallel score line 84. The diagonal score lines 72, 74, 68 and 80 may either be spaced at their lower ends slightly inward from the respective adjacent vertical score lines 30, 32, 34 and 36 along the horizontal score line 16 for improved folding characteristics, or may intersect the junctures of score lines 30 and 16, 34 and 16, 36 and 16, and 34 and 16, respectively, if desired, as shown in FIG. 1.

A pair of oppositely disposed diagonal score lines 86 and 88 are formed on the panel 44, extending from the juncture of the score lines 72/77 and 74/77, respectively, to the free cut edge 53 of the panel 44. A pair of foldback panel portions 90 and 92 are defined by the score lines 72/86/30 and the free cut edge 53, and the score lines 74/88/32 and the free cut edge 53, respectively. A rectangular panel segment 96 is defined by the score line 77, the free cut edge 53, and parallel score lines 98 and 100 extending from the junctures of the score lines 72/77/86 and 74/77/88, respectively, to the free cut edge 53. A pair of segments 102 and 104 are defined by the score lines 86/98 and the edge 53, and the score lines 88/100 and the edge 53, respectively.

A second lift tab 106 is connected by a weakened or perforated line 108 aligned with the free cut edge 53 to form a portion of a side of the rectangular panel segment 96.

The fold-in panel 46 is similar to the panel 44, but longer, as measured from the score line 16. A pair of oppositely disposed diagonal score lines 110 and 112 are formed on the panel 46, extending from the juncture of the score lines 78/84 and 80/84, respectively, to the free cut edge 118 of the panel 46. A pair of foldback panel portions 114 and 116 are defined by the score lines 78/110/34 and the free cut edge 118, and the score lines 80/112/36 and the edge 118, respectively. A rectangular panel segment 120 is defined by the score line 84, the edge 118, and parallel score lines 122 and 124 extending from the junctures of the score lines 78/84/110 and 80/84/112, respectively, to the free cut edge 118. A pair of triangular panel segments 126 and 128 are defined by the score lines 110/122 and the edge 118, and the score lines 112/124 and the edge 118, respectively.

Figure 2:
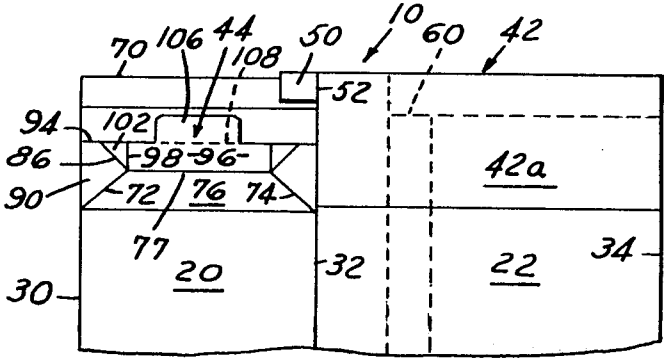
FIG. 2 is a fragmentary layout view of the outside surface of a blank after it is side seamed from the blank illustrated in FIG. 1.

The container blank 10 illustrated in FIG. 1 is formed into a side seamed blank, as illustrated in FIG. 2, by rotating the body panel 24 and side seam flap 26 as a unit about the vertical score line 34, and having the inside surfaces of the body panel 24 come into contact with the inside surface of the body panel 22, with the vertical score line 36 positioned next to the vertical score line 32, and with the inside surface of the side seam flap 26 in contact with the inside surface of the body panel 20 adjacent the vertical score line 32. The body panel 18 is then rotated about the vertical score line 30 to bring its inside surface into contact with the outside surface of the side seam flap 26, and the edge 28 is positioned parallel and substantially aligned with the vertical score line 36. The various members of the end closures 12 and 15 will make similar movement, and the upper end of the container will appear as illustrated in FIG. 2. The container blank 10 is then sealed where the inside areas of the body panel 18 and the enclosure panel 40 come into contact with the outside surface of the side seam flap 26 and its extension 48.

Figure 3:
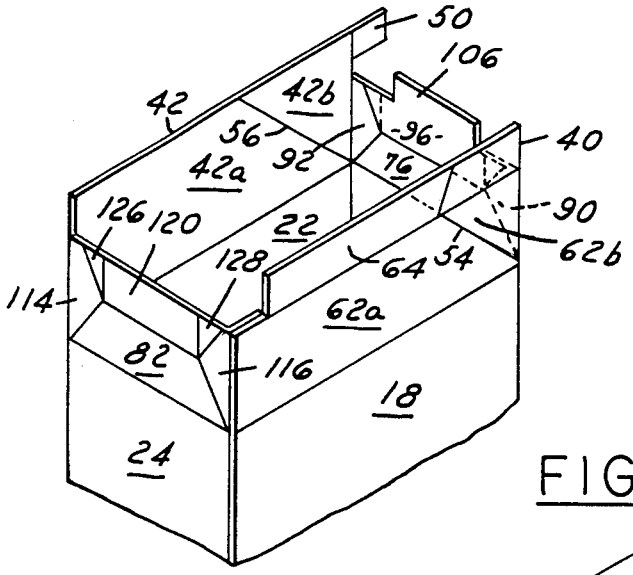
FIGS. 3 and 4 are fragmentary perspective views illustrating sequentially various steps in forming the flat top end closure.

The next step in forming the side seam blank into a container is illustrated in FIG. 3. The side seamed blank is opened up into a squared or rectangular condition, after which the various parts of the end closure 12 are folded about the various score lines in the following manner. Closure panels 76 and 82 are moved about the horizontal score line 16 over the end of the container toward each other. At the same time, the outer closure panels 40 and 42 are also caused to move toward each other about the horizontal score line 16. This causes the foldback panel portion 90 to bend around the vertical score line 30 such that the inside surfaces of the panel portion 90 and the outer panel 40 are approaching each other. Concurrently, the panel portion 92 is moved around the diagonal score line 74 such that the inside surfaces of the panel portion 92 and the panel 42 are approaching each other. The outside surfaces of the two foldback panel portions 90 and 92 approach the outside of the trapezoidal-shaped panel 76. The foldback panel portions 114 and 116 make the same movements as described for the panel portions 90 and 92, with respect to their adjacent panels 42 and 82 and 40 and 82, respectively. Concurrently, the outside surfaces of the rectangular panel segments 96 and 120 are caused to move around the respective score lines 77 and 84 toward the outside surfaces of the adjacent panels 76 and 82, while the triangular segments 102, 104, 126 and 128 are progressively confined between the panel segments of the foldback panel portions 90/96, 92/96, 114/120 and 116/120, respectively. The lift tab 106 remains in a planar relationship with the panel segment 96 beneath the closure panel portions 42*b* and 62*b*.

Figure 5:
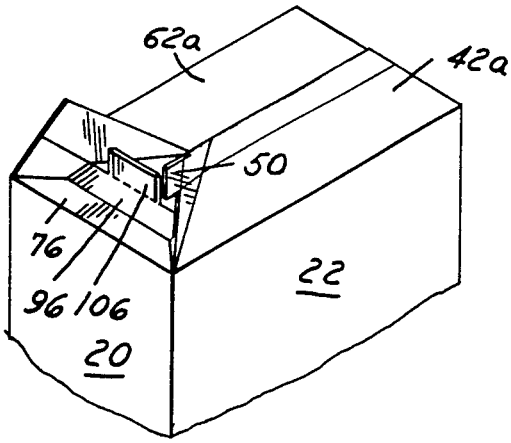
FIGS. 5, 6, and 7 are fragmentary perspective view illustrating sequentially various steps in opening the flat top end closure.
Figure 6:
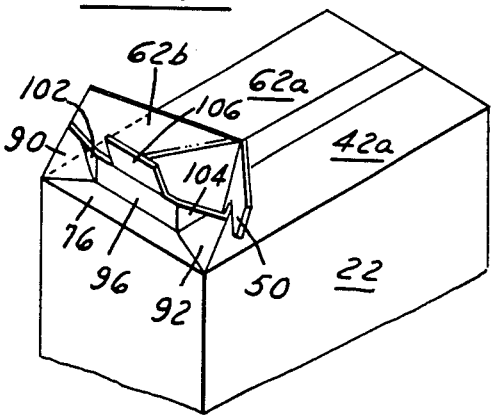

During the folding operation, the outer panel 42 contacts the panel portion 64 of the outer panel 40. The panel portion 64 is moved around the score line 58, approaching the panel portion 62. The result, as shown in FIGS. 5 and 6, is that the score line 58 is exposed to the liquid contents, rather than a raw edge, as would be the case if the panel 64 were not included. An outer panel 42 overlaps and is sealed to the panel portion 64 (FIG. 5) of the outer panel 40.

Figure 4:
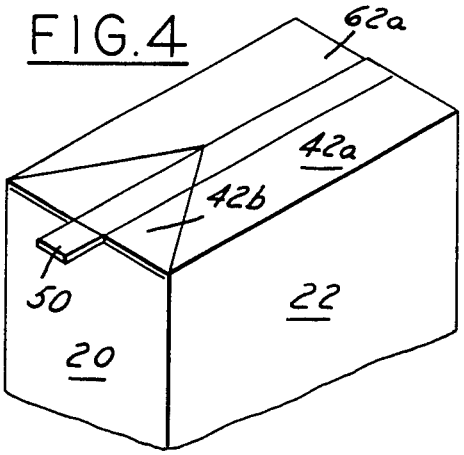

The lift tab 50 (FIG. 4) may be bent downwardly about the score line 52 and sealed against the front panel 20 to accommodate shipping and stacking.

Figure 7:
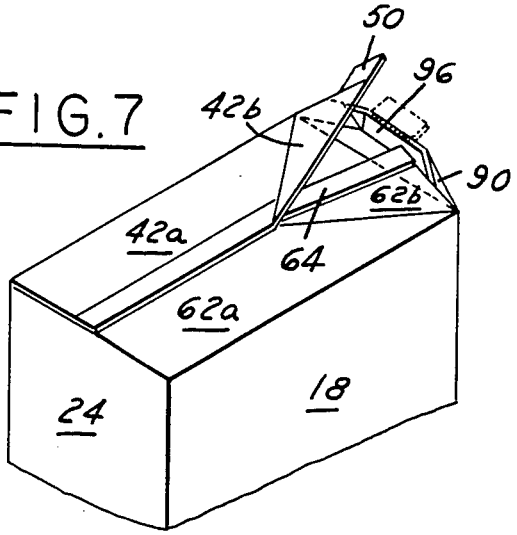
Figure 8:
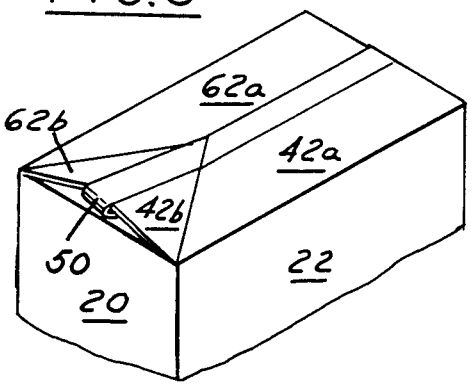
FIG. 8 is a fragmentary perspective view similar to FIG. 4, showing the top closure in a reclosed condition after having been opened.

Referring now to FIGS. 5–7, it may be noted that opening of the flat top closure is effectuated by first releasing the lift tab 50 from the front body panel 20 and then using the released tab to lift the outer roof panel segment **42*b* and the underlying panel portion 92 about the respective diagonal score lines 56 and 74. Next, the panel segment 62*b* is lifted by the corner thereof adjacent the folded-over panel 64. This exposes the underlying portions of the panel 96 and the outwardly projecting lift tab 106, such that one may grasp the lift tab 106. Thus, by grasping and lifting the lift tab 106, the panel 96 is lifted from the panel 76 about the score line 77, and the panel segments 90 and 62*b* are separated from each other about score line 30, and the panel segments 92 and 42*b* are separated from each other about score line 32. Once fully lifted by pulling the tab 106 outwardly as far as possible, thereby bringing the panel segments 76 and 96 into substantially a co-planar condition, the lift tab 106 may be removed by tearing along the perforated line 108. There remains a pouring edge made up of the perforated edge 108 and adjacent portions of the free cut edge 53**.

INDUSTRIAL APPLICABILITY

It is apparent that the resultant flat top container may be stacked more readily during shipping and display than is the case with the conventional gable top container.

It should also be apparent that the flat top closure of the invention may be easily opened by virtue of the two lift tabs and that prior to opening, no top closure raw edges have been exposed to the liquid contents. Insofar as eliminating a raw edge on the vertical side seam 26 and its extension 48 is concerned, various known techniques may be used, such as that shown and described in U.S. Pat. No. 4,572,526.

While but one embodiment of the invention has been shown and described, other modifications thereof are possible within the scope of the following claims.

The embodiments of the invention in which an exclusive property or privilege is claimed are defined as follows:

1. A blank for a flat top end closure for a liquid-carrying paperboard container, said blank comprising four body panels, front and back in-fold panels, and one longer and one shorter outer closure panels, said in-fold and outer closure panels being connected at their inner edges by score lines to respective body panels with their outer edges being free edges, a first lift tab formed on a side edge of the longer panel extending over a portion of the front in-fold panel, each of said front and back in-fold panels including a laterally extending score line formed across a central portion of the width thereof, oppositely disposed converging and diverging score lines extending from opposite ends of the laterally extending score line to respective body panels and the free edges of said in-fold panels, a pair of parallel score lines formed on each of said in-fold panels extending from said ends of each laterally extending score line to said respective free edges, and a second lift tab connected by a perforated line to a central portion of the free edge of said front in-fold panel.

2. The blank described in claim 1, and opening-assist diagonal score lines formed on each of said outer closure panels extending from the inner corners thereof adjacent said front in-fold panel to the respective free edges of the outer closure panels.

3. The blank described in claim 2, and a fold-over panel connected by a score line to the free edge of the shorter outer closure panel.

4. The blank described in claim 3, and a reverse diagonal score line formed across said fold-over panel extending from the end of said adjacent opening-assist diagonal score line at the free edge of the shorter outer closure panel.

5. A paperboard container for holding a liquid, said container comprising four body panels, oppositely disposed front and back in-fold panels, and one longer and one shorter oppositely disposed outer closure panels, said in-fold and outer closure panels being connected by score lines to respective body panels, a fold-over panel connected by a score line to the shorter outer closure panel and folded onto the latter, a portion of said longer outer closure panel overlapping said folded over panel, opening-assist diagonal score lines formed across the respective outer closure and folded over panels adjacent said front in-fold panel, a first lift tab formed on said longer outer closure panel adjacent said front in-fold panel, each of said front and back in-fold panels including an outer rectangular portion folded onto a trapezoidal-shaped inner portion, two fold-back panels overlying portions of the rectangular and trapezoidal-shaped portions beneath said front corners of the respective outer closure panels, and two triangular panels confined between the fold-back panels and rectangular panel portion, and a second lift tab connected by a weakened line to said rectangular panel portion in a co-planar relationship therewith.

* * * * *